United States Patent [19]

Lang et al.

[11] 4,012,577

[45] Mar. 15, 1977

[54] MULTIPLE TWISTED PAIR MULTI-CONDUCTOR LAMINATED CABLE

[75] Inventors: Roger J. Lang, Garden Grove; Lawrence J. Bockhold, Whittier, both of Calif.

[73] Assignee: Spectra-Strip Corporation, Garden Grove, Calif.

[22] Filed: Apr. 30, 1975

[21] Appl. No.: 573,350

[52] U.S. Cl. ..... 174/27; 174/34; 174/117 F

[51] Int. Cl.[2] ..... H01B 7/08

[58] Field of Search ..... 174/27, 34, 117 R, 117 F, 174/117 FF

[56] References Cited

UNITED STATES PATENTS

| | | | |
|---|---|---|---|
| 243,180 | 6/1881 | Ware | 174/117 F X |
| 2,361,374 | 10/1944 | Abbott | 174/117 FF |
| 2,916,055 | 12/1959 | Brumbach | 174/117 R X |
| 3,033,970 | 5/1962 | Eisler | 174/117 FF X |
| 3,082,292 | 3/1963 | Gore | 174/117 F |
| 3,097,036 | 7/1963 | Cornell, Jr. | 174/117 R X |
| 3,158,181 | 11/1964 | Gore | 174/117 R |
| 3,663,739 | 5/1972 | Chevrier | 174/117 F X |
| 3,736,366 | 5/1973 | Wittenberg | 174/117 F X |
| 3,775,552 | 11/1973 | Schumacher | 174/117 F X |
| 3,798,346 | 3/1974 | Kreuzer | 174/27 X |
| 3,819,848 | 6/1974 | Fry | 174/117 F |
| 3,941,966 | 3/1976 | Schatz | 174/117 F |

FOREIGN PATENTS OR APPLICATIONS

| | | | |
|---|---|---|---|
| 580,898 | 11/1924 | France | 174/117 F |
| 815,573 | 7/1959 | United Kingdom | 174/117 F |

*Primary Examiner*—Arthur T. Grimley
*Attorney, Agent, or Firm*—I. Morley Drucker

[57] ABSTRACT

This invention relates to a multi-conductor laminated cable which comprises a plurality of insulated wire conductor twisted pairs laminated between plastic film, the twisted pairs being aligned in the laminated cable in a manner such that each of the twisted pairs may be separated and terminated more readily, and faster, than present state of the art laminated twisted pair cable — with little sacrifice in the electrical characteristics. Further, the resulting laminated cable of this invention has an overall narrower cable width for a given number of twisted pairs laminated therein.

10 Claims, 8 Drawing Figures

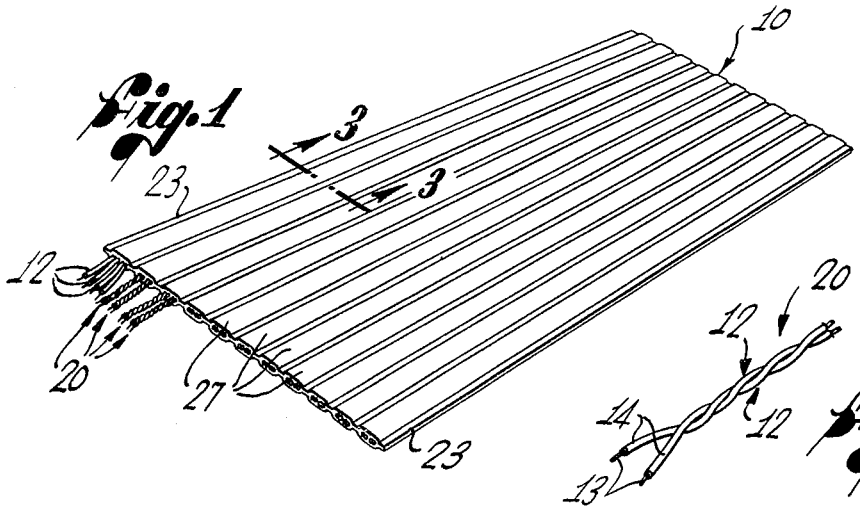
Fig. 1
Fig. 2
Fig. 6
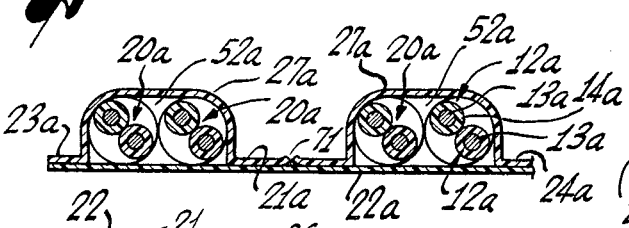
Fig. 3
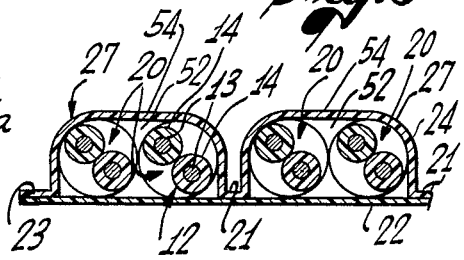
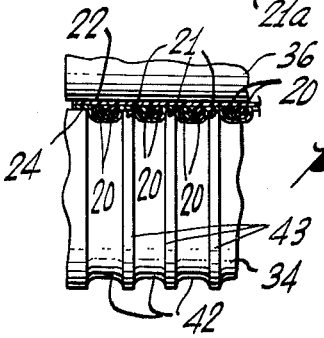
Fig. 5
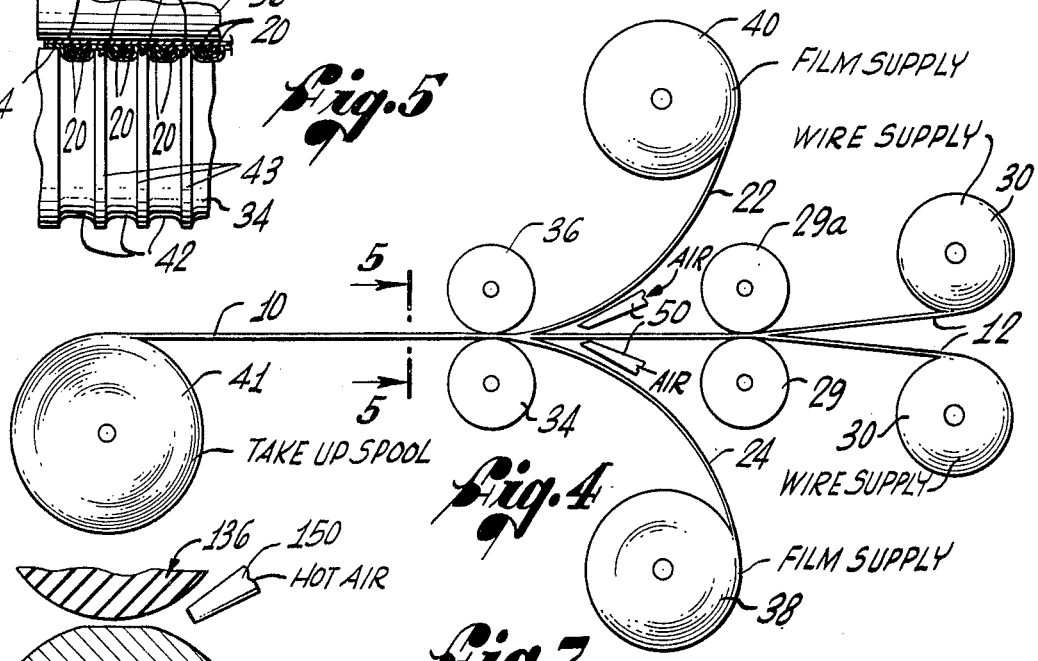
Fig. 4
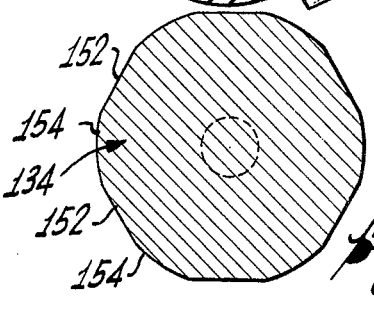
Fig. 8
Fig. 7
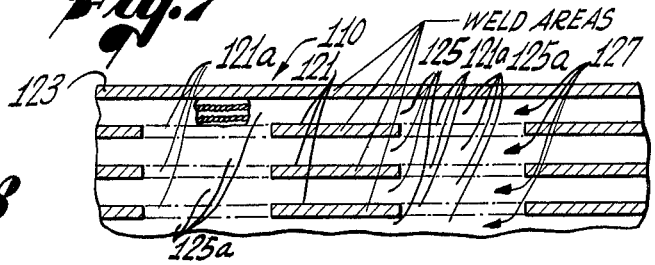

MULTIPLE TWISTED PAIR MULTI-CONDUCTOR LAMINATED CABLE

To achieve the foregoing, two (or more) twisted pairs of insulated conductors are aligned such that these twisted pairs actually contact each other in side to side relationships. An adjacent group of two (or more) twisted pairs are spaced, laterally, from the first group of two (or more) twisted pairs by a predetermined distance. Any desired multiple of groups of twisted pairs are aligned in this manner. The thusly spaced groups of twisted pairs are maintained in this just-described alignment by being laminated between plastic film. The plastic film, forming the alignment means for the multi-conductor cable of this invention, has a. a plurality of spaced encapsulating ducts formed therein, each encapsulating duct containing at least two twisted pairs of insulated conductors and b. generally flat areas of laminated plastic film extending laterally between, and joining, each of said spaced encapsulating ducts, and generally referred to as "nip" areas.

It is much easier and faster to separate and terminate the twisted pairs from this just-described alignment as compared with individually laminated twisted pair laminated cable which is standard in the art. Furthermore, no significant alteration in electrical characteristics results from this alignment and the overall cable width is narrower for a given number of twisted pairs, as compared to the state of the art laminated cable.

CROSS REFERENCE TO RELATED APPLICATION

This application is related to co-pending application Ser. No. 545,582 filed Jan. 30, 1975 and entitled TWISTED PAIR MULTI-CONDUCTOR RIBBON CABLE WITH INTERMITTENT STRAIGHT SECTIONS, this co-pending application being assigned to the same assignee as this application.

BACKGROUND OF THE INVENTION

It has become increasingly important to accurately space the insulated multiple conductors with respect to each other and laminated flat ribbon cable has increasingly come into use for this purpose. Precise control of electrical characteristics such as impedance, capacitance, cross talk and attenuation, especially important in digital data, and signal, transmission is thereby achieved. Both controlled regular spacing and controlled irregular spacing, of multiple conductors in ribbon cable form, has been achieved, in the prior art, by laminating the accurately spaced insulated (or uninsulated) multiple conductors between thin plastic film, such as 5 mil polyvinyl chloride (pvc) film or 5 mil polytetrafluoroethylene film.

Multiple pairs of insulated wires have also been accurately spaced, in ribbon cable, by laminating multiple pairs of twisted insulated conductors between plastic film, each individual twisted pair being first laid onto a lower plastic film and encapsulated and accurately oriented by an upper plastic film laminated to the lower film. The use of multiple twisted pairs in multi-conductor cable is of great importance in the field of communications, data processing and other applications where cross-talk in signal transmission must be kept to a minimum. The twisted pairs of the laminated, twisted pair, multi-conductor ribbon cable of the prior art are, however, difficult to separate and untwist from the laminate because each individual twisted pair is tightly encapsulated and/or bonded within the laminated film. More specifically, the conductors of each individual twisted pair are round, in cross-section, and the laminating plastic film readily conforms to the shape of the conductors during lamination under the influence of heat and pressure. Thus, even though each individual twisted pair is laterally separated from an adjacent individually encapsulated twisted pair, by an area, generally known as a "nip area" or a "bite area" in the art, it is nevertheless difficult to separate the individual twisted pair from the surrounding plastic film because of the tightly conforming nature of the plastic film to each individual twisted pair. For these reasons, it is time-consuming and costly to separate each twisted pair from the multi-conductor laminated cable of the prior art.

The invention is therefore directed towards an improved multi-conductor laminated cable, having a plurality of twisted pairs of cables laminated therein, in a unique manner, which overcomes the just-mentioned time consuming problems of separating and untwisting the cable for termination purposes without appreciably affecting the electrical characteristics if the cable, and furthermore improving the cable by having a narrower width for a given number of twisted pairs.

SUMMARY OF THE INVENTION

This invention is directed to a laminated, multi-conductor ribbon cable which comprises a first laminating plastic film on which is placed a pluralty of groups of twisted pairs of round insulated conductors. Each of said groups of twisted pairs are predeterminedly spaced with respect to the other groups, but each twisted pair within a group is aligned in side to side contacting relationship. At the present time, two twisted pairs of conductors preferably comprise each group, but three or more twisted pairs, in side to side contacting relationship may also comprise a group. A second laminating plastic film encapsulates and orients the plurality of groups of twisted pairs of insulated conductors along the just-described alignment.

The first and second plastic films are preferably heat welded or heat sealed under pressure, to each other, on either side of each group of twisted pair conductors, and the films may also be heat welded to the insulation of the conductor themselves in order to precisely anchor and space the conductor pairs, with respect to adjacent conductor pairs.

The resulting multi-conductor laminated cable of this invention is probably best briefly described as one which comprises a laminated plastic film having a plurality of elongated encapsulating ducts formed therein, each encapsulating duct containing a group of two or more twisted pairs of round insulated conductors, and having generally flat sealed nip areas extending laterally between, and joining, each of said spaced encapsulating ducts.

Because each group of two or more twisted pairs of round insulated conductors are encapsulated between nip areas, a "cavity" is inherently formed between a portion of the plastic film of the encapsulating duct and the round conductors of the twisted pairs. A slitting or cutting tool can readily be inserted into the cavity to cut the film a short distance e.g. ¼ inch to expose one or more of the twisted pairs. The twisted pairs can then be separated by merely pulling one or more of the twisted pairs, in a shear mode, through the encapsulating duct, to the desired length. The twisted pair, or pairs, are thus quickly separated from the main multi-conductor cable. The separated pairs are readily untwisted, because of the absence of any laminating film, for termination.

In the prior art twisted pair laminated cable, the presence of but one twisted pair in each encapsulating duct results in a tightly conforming encapsulation of plastic film to round conductor, and thereby renders much difficult insertion of a cutting tool into the duct to free the twisted pair. Furthermore, in order to free two (or more) twisted pairs, two (or more) encapsulating ducts must be cut requiring two (or more) separate cutting motions before separation of the twisted pairs, from the main cable, can take place.

Thus, it can be seen that the encapsulation of groups of twisted pairs, in side to side relationship, results in a much easier and faster separation of one or more twisted pairs from the main cable, results also in an easier separation of one twisted pair from another and also easier untwisting, since the twisted pairs do not need to be tightly encapsulated as in the prior art cable.

The resulting cable of this invention is generally narrower in width than twisted pair cable of the prior art.

The number of twisted pairs in a group may vary from a minimum of two to a normal maximum of four, and the number of groups, and the width of the nip areas therebetween, can be readily varied over a wide range.

The nip areas may incorporate a "tear line" (a line of reduced thickness of plastic film) thereby enabling each group of twisted pairs to be more easily separated from the main cable.

This invention also is directed to the combination of the twisted pair laminated cable just described, but with intermittent bonding of the upper and lower films along the length of the cable. Thus, in the laminated cable of this invention, the welding of plastic films in the nip areas may be continuous along the length of the insulated conductor pairs but in the combination including the intermittent bonding, the welding of the laminated films to each other at the nip areas and/or the welding of the plastic film to the insulation of the conductor pairs is intermittent in regular patterns of sealed and unsealed portions.

BRIEF DESCRIPTION OF THE DRAWINGS

FIG. 1 is a perspective view of a portion of a presently preferred embodiment of the multiple twisted pair laminated multi-conductor cable of this invention;

FIG. 2 is a perspective view of a portion of a single twisted insulated conductor pair, per se, without any laminated film therearound;

FIG. 3 is a fragmentary cross-sectional view of the ribbon cable, taken along the line 3—3 of FIG. 1;

FIG. 4 is a schematic view of the process steps for producing the cable of FIGS. 1–3;

FIG. 5 is an elevational view of the laminating rollers taken along the line 5—5 of FIG. 4;

FIG. 6 is a cross-sectional view of a second embodiment of a multi-conductor laminated cable of this invention;

FIG. 7 is a plan view of a third embodiment of the multi-conductor laminated cable of this invention; and FIG. 8 is an enlarged, fragmentary view, in cross-section, of another embodiment of the laminating rollers shown in FIG. 4.

DETAILED DESCRIPTION OF THE INVENTION

One embodiment of the multiple twisted pair multi-conductor laminated cable of this invention is shown in FIGS. 1–3 and is designated by the numeral 10. The cable 10 comprises a plurality of aligned, laterally spaced, groups of twisted pairs of round insulated conductors 12, a group of two twisted pairs being shown in side to side contact with each other, although it will be understood that groups of three or more twisted pairs may be employed in side to side alignment.

A portion of an individual twisted pair is shown in FIG. 2, each insulated conductor 12, in turn, comprising a central metal conductor, e.g., of copper or aluminum 13 with a preferably round pvc or other plastic insulation 14 formed therearound. Twisted pairs of insulated conductors 12 are highly preferred over straight conductor pairs because of the reduction of cross-talk in signal transmission and for other reasons, as previously mentioned.

Each twisted pair of insulated conductors is designated, generally, by the numeral 20. The insulation 14 on each conductor 13 is round, in cross-section, and the insulated conductors 12 are twisted about a given twist rotation, (i.e. clockwise or counterclockwise) and with a given lay per inch. Each insulated conductor 12 of a twisted conductor pair 20 is normally color coded, or otherwise distinctly marked, so as to differentiate it from the other insulated conductor in the conductor pair.

A multiple number of groups of two insulated conductor twisted pairs 20 are then aligned so that each of the two twisted pairs 20 within the group lie in side to side contacting or contiguous relationship, with each other, as best shown in FIGS. 1 and 3. Inasmuch as the round conductor pairs 20 are twisted, each twisted pair 20 in a group touches, or contacts, the other pair, in a noncontinuous fashion, and the term "side to side contiguous or contacting relationship", as used herein, and in the claims, with reference to the placement of twisted pairs in a group defines a repetitive, but not necessarily, continuous contact of the circumference of one twisted pair with the circumference of another twisted pair within a given group.

A plurality of groups of twisted conductor pairs 20 are then spaced on a first laminating plastic film 24 and a second plastic film 22 is laminated thereto to encapsulate the twisted conductor pairs.

The plastic films 22 and 24 are preferably made of pvc or Teflon, but many other plastics may also be employed. These plastic films are readily fusable to each other under the influence of heat and pressure.

More specifically, and referring now to FIGS. 4 and 5 in particular, a plurality of round insulated conductors 12 are first twisted into conductor pairs 20 by conventional means. One resulting conductor pair 20 is shown, by way of example only, in FIG. 2. The twisted pairs 20 are then wound on supply rollers 30.

The twisted conductor pairs 20 are conveyed from supply rollers 30 (only two of which are shown in FIG. 4) and are aligned in group of two twisted pairs per group in the side to side contiguous relationship previously described, each group being, in turn, spaced laterally, from the other groups of twisted pairs, by a predetermined distance. The lateral alignment of groups of twisted pairs is achieved by placing the twisted conductor pairs 20 into accurately spaced grooves machined into a laminating roller 34, as will be later described. The laterally spaced groups of twisted pair conductors are preferably, first passed through alignment rollers 29, 29a for the purpose of achieving exact alignment in a horizontal plane.

The plurality of aligned groups of twisted conductor pairs 20 are then conveyed through laminating rollers 34, 36 along with first (lower) and second (upper) plastic films 24 and 22, respectively. The lower and upper plastic films 24, 22 are supplied from film supply rollers 38, 40, respectively.

The lower laminating roller 34 is preferably made of aluminum and has multiple grooves 42 and shoulders 43 formed therein, the multiple grooves being spaced along the roller 34 at intervals determined by the particular spacing of groups of conductor pairs 20 desired in the finished cable 10.

The lower plastic film 24 is thin and flexible, and readily conforms to the groove pattern of the roller 34. The grooves 42 are machined to a width that wholly includes both insulated conductor twisted pairs 20, and is of a depth sufficient to include all, or at least a substantial portion of, the conductor pairs. This is best shown in FIG. 5 wherein it can be seen that the depth of the grooves is approximately twice the diameter of one of the insulated conductors 12 of a conductor pair 20, and the width of the grooves accommodates the width of both twisted conductor pairs 20 as well as the plastic film.

The upper roller 36 is preferably made of hard rubber, or with a hard rubber facing, and as the plastic films 22, 24 and the twisted conductor pairs 20 pass between the laminating rollers 34, 36, the plastic films 22, 24 are continuously laminated to each other at the nip areas 21, and at the side edges 23 of the cable 10, under the pressure applied by the rollers 34, 36, and also under the influence of heat. The heat source is, preferably, a sorce of hot air, supplied through air nozzles 50 placed closely adjacent the laminating rollers 34, 36, as schematically shown in FIG. 4. The critical bonding temperature for the plastic film employed is well known in the art, for any particular plastic film chosen.

The resulting cable 10 is wound on a take-up spool 41, the cable 10 having a plurality of groups of twisted conductor pairs 20, precisely oriented and spaced, with respect to each other, by means of the upper and lower laminated plastic films 22, 24. The upper and lower plastic films 22, 24, once laminated, can be described as forming, an alignment means comprising a bonded laminate, or a unitary plastic film, having a plurality of spaced encapsulating ducts 27, each of the ducts containing two (or more) of said insulated conductor twisted pairs 20, the bonded laminate also having nip areas 21 extending laterally between, and joining each of said spaced encapsulating ducts.

The double conductor twisted pairs 20 are firmly anchored, mechanically, by the encapsulating ducts 27 formed by plastic films 22, 24. It is presently preferred that the encapsulating ducts 27 not adhere to the insulation 14 of the conductors 12 contained therein. To this end, the insulation 14 of the conductors 12 is made non-adherent to the plastic film by any one of a number of methods well known in the prior art. For example, if a small percentage of silicone is incorporated into a pvc conductor insulation, the pvc plastic films 22, 24 will not adhere to the insulation so that only the films 22, 24 will be bonded to each other along the nip areas 21 and edges 23.

Because two (or more) twisted pairs 20 of round insulated conductors are encapsulated within a duct 27 a cavity 52 is inherently formed between an overlying flat portion 54 of the encapsulating duct 27 and the arcuate circumferences of the round conductors of the twisted pairs 20. A slitting or cutting tool can readily be inserted into the cavity 52 to cut the duct 27 a short distance e.g. ¼ inch to expose one or more of the twisted pairs 20. One or more of the twisted pairs 20 can then be separated from the main cable 20 by merely pulling the twisted pairs, in a shear mode, through its encapsulating duct 27, until the desired length is obtained. The twisted pair, or pairs, are thus quickly separated from the main multi-conductor cable. The separated pairs are readily untwisted for termination because of the absence of any tight encapsulation, and absence of film laminated thereto.

In the prior art twisted pair laminated cable, the presence of but one twisted pair in each encapsulating duct results in a much more tightly conforming encapsulation of plastic film to round conductor, and thereby renders more difficult insertion of a cutting tool into the duct to free the twisted pair. Furthermore, in order to free two (or more) twisted pairs, two (or more) encapsulating ducts must be cut requiring two (or more) separate cutting motions before separation of the twisted pairs, from the main cable, can take place.

Thus, encapsulation of groups of two (or more) twisted pairs, in side to side relationship, within an encapsulating duct, results in a much easier and faster separation of one or more twisted pairs from the main cable, results also in an easier separation of one twisted pairs from another and also easier untwisting, since the twisted pairs do not need to be tightly encapsulated as in the prior art cable.

The number of twisted pairs in a group may be readily varied from a minimum of two to a normal maximum of four, and the number of groups, and the width of the nip areas 21 there between, can be readily varied over a wide range.

The resulting cable of this invention is generally narrower in width than twisted pair cable of the prior art for a given number of twisted pairs — because the prior art cable required spacing of each twisted pair from the adjacent twisted pair — thereby resulting in a relatively wide cable. In the cable 10 of this invention, the spacing is minimized by the grouping of twisted pairs in side to side contiguous relationship. The sacrifice in electrical characteristics, for most applications, is not significant, most electrical characteristics of double twisted pairs in side to side contiguous relationship being within ten percent of those of separated individual twisted pairs.

The width of the nip areas 21 can be varied widely. A typical nip area 21 will preferably add about 0.020 inch to the width of the cable 10. Furthermore the placement of the nip areas 21 in the cable can be greatly varied.

The stranding of the wires in the conductor 13, the gage of wire, the number of twisted pairs forming a multi-conductor cable, the insulation material and thickness, the laminating film material and thickness, are all readily varied, within wide limits.

A second cable embodiment 10a is shown in FIG. 6 which differs from cable 10 only in the nip area. Thus, cable 10a is provided with an upper and lower laminating plastic film 24a, 22a forming a plurality of encapsulating ducts 27a encapsulating twisted pairs 20a of round insulated conductors 12*a*. Cavities 52*a* are formed comparable to cavities 52 of cable 10, and for the same purpose as cavities 52. The upper and lower films 24*a*, 22*a* are laminated to each other between ducts 27*a* to form nip areas 21*a*, as in cable 10. However, nip areas 21*a* are typically wider than nip areas 21, e.g. 0.040″ to accommodate a "tear line" 71, a tear line being a line of reduced thickness of plastic film. Tear line 71 enables each group of encapsulated twisted pairs 20*a* to be more easily separated from the remainder of cable 10*a*.

It should be noted tht cables 10, 10*a* of this invention have been shown and described as incorporating continuous weld lines along the nip areas 21 and 21*a* respectively. The films forming the encapsulating duct 27 are however preferably not adherent to the insulation of the conductors 12 encapsulated therein in order to enable the twisted pairs to be easily separated, untwisted and terminated.

Cable 10, 10*a* of this invention render it possible for one or several groups of twisted pairs, or one twisted pair of a group to be easily and quickly separated from the main cable. However, it is also frequently desired to have not only several twisted pairs to be separated quickly from the cable, but to have all of the twisted pairs quickly delaminated for termination purposes. This is readily accomplished by means of a third embodiment of the cable of this invention shown in FIG. 7, and designated generally by the numeral 110.

Cable 110 comprises a plurality of groups of twisted conductor pairs 120, as hereinbefore described with reference to FIGS. 1–3 encapsulated in ducts 127 between upper and lower plastic films. However, in cable 110, the upper and lower plastic films are only intermittently sealed to each other along the nip areas 121. The bonded or sealed nip areas are indicated by the numeral 121 and the unbonded nip areas by the numeral 121*a*. The plastic films are preferably not bonded to the insulation of the conductor pairs. The bonding of the plastic films to each other in the nip areas at 121 are in a pattern of lateral alignment.

The side edges 123 of the cable 110 are preferably continuously bonded, as shown in FIG. 7, but may also be intermittently bonded in the same, or different intermittent pattern as shown for the nip areas 121, 121*a* and for the intermittently bonded plastic films.

The intermittently bonded cable 110, just described, enables delamination of the entire cable to readily occur, when desired. This is accomplished by first cutting cable 110 laterally along unbonded areas 121*a*, 125*a*. The unbonded (and loose) plastic film may then be readily peeled back, from such unbonded section, as far along the cable as desired, and preferably until another unbonded section 121*a*, 125*a* is reached. (The bonded areas 121 of plastic film are readily designed to be overcome or delaminated by a normal manual pulling force exerted on one or both of the laminating plastic films.) The cable 110 is then cut at the point where the plastic film has been peeled back thereby exposing all of the twisted pairs of the cable for untwisting and termination.

The intermittent bonding of the plastic films in cable 110, is effected simply by means of the processing line of FIG. 4 in conjunction with specialized laminating rollers 134, 136 shown schematically, in cross-section, in FIG. 8. The cross-section taken is along a nip or shoulder area, i.e. between grooves of the roller 136. The lower and upper plastic films, encapsulating the double twisted conductor pairs, pass between the laminating rollers 134, 136 of FIG. 8, wherein upper roller 136 is a hard rubber roller substantially the same as roller 36. Roller 134 is a grooved roller, similar in configuration to roller 34 of FIG. 5 except that roller 134 is provided with alternating flat areas 152 and circular areas 154 formed on the nip areas of the roller. As the hot plastic films pass adjacent the flat nip portions of roller 134, no contact of the two films is made at that instant, and no bonding of the films takes place either in the nip areas 121*a*. Conversely, however, as arcuate nip portions 154 of roller 134 abut the lower plastic film, such abutting portions of the hot plastic film will contact the upper hot plastic film, abutting upper roller 136, and adherent contact of the plastic films will be made with the resulting intermittent welding pattern of the nip areas being shown in FIG. 7. The welding pattern along side edges 123 is continuous, however, because the outer edges of roller 134 are completely round, and will effect a continuous contact of the upper and lower plastic films constituting the side edges 123 of cable 110, as with cable 10.

It is presently preferred that the edges 123 of cable 110 be continuously welded (e.g., heat bonded) rather than being intermittently welded. When the edges 123 are continuously welded, as shown, the hot air, blowing from a nozzle 150 (in FIG. 8) onto the plastic film, will not escape through the side edges of the cable 110. The thusly entrapped air will more effectively support the upper plastic film, in spaced fashion with respect to the lower plastic film, and thereby positively prevent bonding of the film adjacent the flat areas 152 of roller 134 — where film bonding is not desired. Intermittent bonding of the plastic film side edges 123 can also be utilized in combination with intermittent bonding internally thereof.

While the encapsulating ducts 127 of cable 110 are preferably not made adherent to the insulation of the encapsulated twisted pairs, the processing can be readily varied to effect such bonding, if desired. Thus, for example the insulation of the conductor would not contain a silicone release agent. Further, if intermittent bonding of the insulation of the twisted pairs to the plastic films forming the encapsulating ducts 127 is desired e.g. at areas 125 which are laterally aligned with nip areas 121, the grooves of roller 134 can be modified, in the same manner as the nip areas of the roller 134, to effect intermittent bonding. Thus, when areas 125 of ducts 127 are bonded, areas 125*a* of duct 127 may remain unbonded by machining alternating flat and circular areas of the desired length in each of the grooves of roller 134.

Other methods of intermittent bonding may also be employed, such as those disclosed in the co-pending application of Lawrence (Larry) J. Bockhold, entitled "Easy Termination Multi-Conductor Ribbon Cable, and Process for Making Same" filed Mar. 25, 1975, and bearing Ser. No. 561,998, the subject matter of that application being wholly incorporated herein, by this reference.

It will be understood that the intermittent bonding patterns and spacing and orientation of the conductors may be varied considerably depending only upon configuration of the lower roller. By way of example only, the alternating flat areas 152 may each occupy a 30° segment of a circle.

Various modifications of the invention herein set forth will become apparent to those skilled in the art.

Thus, in some applications, it may be of advantage to partially bond the encapsulatiing ducts 27 of FIGS. 1–3 to the insulation 14 of the conductors. For example, only one of plastic films 22, 24 forming the ducts 27 may be bonded to the conductor insulation 14 for precise conductor placement, while the other of the plastic films forming ducts 27 may be entirely unbonded to the conductor insulation. In other applications, where very rapid separation of a portion of a cable containing a number of groups is desired from that of the main cable, a cable having one or more nip areas with a tear line incorporated therein, would be utilized with or without intermittent bonding of those nip areas not having the tear line. Therefore, I do not intend to be limited by the forms of the invention herein shown and described but only by the claims which follow.

We claim:

1. A multi-conductor cable which comprises:

a first and second plastic film bonded together to form a) a plurality of spaced encapsulating ducts and b) nip areas extending laterally between and joining each of said encapsulating ducts;

a plurality of groups of round, insulated, conductor twisted pairs, each said group consisting of at least two twisted pairs of said round, insulated, conductors and each of said twisted pairs in each said group lying in side to side contiguous relationship with another of said twisted pairs in said group;

each of said spaced encapsulating ducts containing one of said groups of insulated round conductor twisted pairs, said encapsulating ducts and said nip areas coacting as alignment means for said groups of round insulated conductor twisted pairs; and a plurality of longitudinally extending cavities, at least one cavity being formed within each of said encapsulating ducts and being defined by an overlying portion of each encapsulating duct and any two of said round insulated twisted conductor pairs contained within each said duct, each of said cavities providing a means for easy entry of a severing tool into each said duct.

2. The multi-conductor cable of claim 1 wherein said encapsulating ducts are at least partially bonded to the insulation of said encapsulated twisted pairs.

3. The multi-conductor cable of claim 1 wherein said encapsulating ducts are intermittently bonded to the insulation of said encapsulated twisted pairs.

4. The multi-conductor cable of claim 1 wherein said encapsulating ducts are substantially free of the insulation of said encapsulated twisted pairs.

5. The multi-conductor cable of claim 1 wherein said first and second plastic films constituting said nip areas are continuously bonded to each other to form a unitary plastic film.

6. The multi-conductor cable of claim 1 wherein at least one of said nip areas have a tear line formed therein.

7. The multi-conductor cable of claim 1 wherein at least one of said nip areas have a tear line formed therein and the remaining nip areas are intermittently bonded.

8. The multi-conductor cable of claim 1 wherein said first and second plastic films constituting said nip areas are intermittently bonded to each other.

9. The multi-conductor cable of claim 1 wherein said encapsulating ducts are intermittently bonded to the insulation of said encapsulated twisted pairs, and said first and second plastic films constituting said nip areas are intermittently bonded together, the bonded areas of said encapsulating ducts and the bonded areas of said nip areas being in substantially lateral alignment.

10. The multi-conductor cable of claim 1 wherein the lateral marginal edges of said first and second plastic films comprise the outer side edges of said cable and said lateral marginal edges are continuously bonded.

* * * * *